US008993500B2

(12) United States Patent
Tajmamet et al.

(10) Patent No.: US 8,993,500 B2
(45) Date of Patent: Mar. 31, 2015

(54) CLEANING AND DISINFECTING LIQUID HAND DISHWASHING DETERGENT COMPRISING A BENZYL ALCOHOL/ETHANOL MIXTURE

(71) Applicant: The Procter & Gamble Company, Cincinnati, OH (US)

(72) Inventors: Jamila Tajmamet, Boite (BE); Robby Renilde François Keuleers, Lippelo (BE); Marie-Emile Lascaux, Etterbeek (BE); Shruti Amar Sachdev, Spring Grove (SG); Vaishali Shailendra Rane, Thane Maharashtra (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/331,253

(22) Filed: Jul. 15, 2014

(65) Prior Publication Data

US 2014/0323380 A1 Oct. 30, 2014

Related U.S. Application Data

(63) Continuation of application No. 14/066,718, filed on Oct. 30, 2013, now Pat. No. 8,846,591.

(30) Foreign Application Priority Data

Oct. 30, 2012 (EP) ..... 12190614

(51) Int. Cl.

| | |
|---|---|
| ***C11D 1/29*** | (2006.01) |
| ***C11D 3/48*** | (2006.01) |
| ***C11D 3/20*** | (2006.01) |
| ***C11D 3/34*** | (2006.01) |
| ***C11D 3/43*** | (2006.01) |

(52) U.S. Cl.

CPC ..... *C11D 3/48* (2013.01); *C11D 3/2034* (2013.01); *C11D 3/2086* (2013.01); *C11D 3/3418* (2013.01); *C11D 3/43* (2013.01)

USPC ..... 510/131

(58) Field of Classification Search

CPC ..... C11D 1/29

See application file for complete search history.

(56) References Cited

U.S. PATENT DOCUMENTS

| | | | | |
|---|---|---|---|---|
| 3,812,044 | A | 5/1974 | Connor et al. | |
| 3,915,903 | A | 10/1975 | Wise | |
| 4,070,309 | A | 1/1978 | Jacobsen | |
| 4,297,251 | A | 10/1981 | Bernardino | |
| 4,576,738 | A | 3/1986 | Colodney et al. | |
| 4,704,233 | A | 11/1987 | Hartman et al. | |
| 4,992,212 | A | 2/1991 | Corring et al. | |
| 5,851,974 | A | 12/1998 | Sandhu | |
| 6,090,772 | A | 7/2000 | Kaiser et al. | |
| 6,331,516 | B1 | 12/2001 | D'Ambrogio et al. | |
| 6,855,680 | B2 | 2/2005 | Smerznak et al. | |
| 8,309,504 | B2 | 11/2012 | Murphy et al. | |
| 2003/0161757 | A1 | 8/2003 | Evans | |
| 2006/0035807 | A1* | 2/2006 | Kasturi et al. | 510/475 |
| 2006/0234893 | A1 | 10/2006 | Busch et al. | |
| 2006/0264349 | A1 | 11/2006 | Connors et al. | |
| 2008/0233057 | A1 | 9/2008 | Viladot Petit et al. | |
| 2010/0323943 | A1* | 12/2010 | Evers et al. | 510/236 |
| 2011/0152158 | A1* | 6/2011 | Bettiol et al. | 510/237 |
| 2013/0261038 | A1 | 10/2013 | Tajmamet et al. | |
| 2014/0121147 | A1 | 5/2014 | Tajmamet et al. | |

FOREIGN PATENT DOCUMENTS

| | | | |
|---|---|---|---|
| EP | 0 040 882 | A1 | 12/1981 |
| EP | 0 160 762 | A1 | 11/1985 |
| EP | 0 855 439 | A1 | 7/1998 |
| EP | 2 338 961 | A1 | 6/2011 |
| EP | 2 436 754 | A1 | 4/2012 |
| WO | WO 96/06152 | A2 | 2/1996 |
| WO | WO 97/39089 | A1 | 10/1997 |
| WO | WO 98/56497 | A1 | 12/1998 |
| WO | WO 99/05082 | A1 | 2/1999 |
| WO | WO 99/05084 | A1 | 2/1999 |
| WO | WO 99/05241 | A1 | 2/1999 |
| WO | WO 99/05242 | A1 | 2/1999 |
| WO | WO 99/05243 | A1 | 2/1999 |
| WO | WO 99/05244 | A1 | 2/1999 |
| WO | WO 99/07656 | A2 | 2/1999 |
| WO | WO 00/23548 | A1 | 4/2000 |
| WO | WO 00/23549 | A1 | 4/2000 |

OTHER PUBLICATIONS

Biocidal Compositions containing 4, 4-dichloro 2-hydroxy diphenylether (DCPP), IP.com Journal, IP.com Inc., West Henrietta, NY, US; Dec. 20, 2011; XP013148648; pp. 3-5 examples.

EPO Search Report; Application No. 12190614.3-1358; Dated Oct. 4, 2013; 10 Pages.

* cited by examiner

*Primary Examiner* — Charles Boyer

(74) *Attorney, Agent, or Firm* — Amy Ahn-Roll

(57) ABSTRACT

The invention relates to a liquid cleaning and disinfecting hand dishwashing detergent composition comprising at least one surfactant selected from the group consisting of anionic, nonionic, cationic, zwitterionic, amphoteric surfactants, and mixtures thereof, at least one organic solvent and/or at least one hydrotrope, and a single antibacterial active and/or at least one sequestering agent. The cleaning and disinfecting hand dishwashing detergent composition eliminates 99.999% of *Escherichia coli, Pseudomonas aeruginosa, Staphylococcus aureus* and *Enterococcus hirae* in no more than 5 minutes at an 80% product concentration and 20 degrees Celsius according to the EN1276 suspension test The present invention further relates to methods of cleaning and disinfecting dishware and/or dishwashing implements and/or skin using such a liquid of cleaning and disinfecting detergent composition.

15 Claims, No Drawings

CLEANING AND DISINFECTING LIQUID HAND DISHWASHING DETERGENT COMPRISING A BENZYL ALCOHOL/ETHANOL MIXTURE

FIELD OF INVENTION

The present invention relates to liquid hand dishwashing compositions, killing 99.999% of bacteria in a 5 minute suspension test (EN1276) using an optimized mixture of materials while still delivering a desired consumer aesthetic and performance profile at an affordable formulation cost.

BACKGROUND OF THE INVENTION

The cleaning and disinfecting of hard surfaces is important in both residential and commercial settings. The increasing importance of hygiene combined with the fast moving pace of the modern world has created a need for products with fast cleaning and disinfecting action. The main concerns are to effectively reduce bacteria and maintain a consumer acceptable aesthetics profile while producing an acceptable human and environmentally safe composition. As will be appreciated, this implicitly puts constraints on the amount and type of chemicals that can be used to formulate a commercially acceptable composition.

Within the European Union disinfecting products are regulated through the Biocidal Product Directive/Regulation, aiming at restricting the use of hazardous disinfecting agents while otherwise setting minimum efficacy requirements for disinfecting product compositions behind the European Union standard suspension test, European Norm 1276 (EN1276). This EN1276 test is a standard test for the evaluation of the effectiveness of biocidal compositions in the European Union. The test was designed to simulate dirty conditions and allows for evaluating a product simultaneously exposed to cleaning and disinfecting. Organic soils and hard water are known to interfere with the activity of biocides, so the use of interfering substances, namely bovine albumin (0.3%) and hard water), represent the soil likely to be found when cleaning. The use of these interfering substances in the presence of quantitatively and qualitatively known bacteria (*Pseudomonas aeruginosa, Escherichia coli, Staphylococcus aureus, Enterococcus hirae*) ensures a rigorous test standard under dirty conditions. To pass EN1276 and, as such, to claim to be a disinfectant product, a log 5 reduction (99.999% kill) of the bacteria must be attained within 5 minutes at an 80% product concentration at 20 degrees Celsius.

Very few formulations are described in the literature passing this challenging testing protocol. For example, one formulation, for skin and hospital disinfection purposes, passes the EN1276 success criteria using very high solvent levels, especially alcohols. However, a formulation high in solvents would not be satisfactory as a household detergent composition, including hand dishwashing detergents, due to viscosity, product odor, product labeling and formulation cost constraints.

Yet another example in the literature describes a formulation that passes the EN1276 protocol using a mixture of two antibacterial agents combined with a sequesterant, solvent and/or surfactant. However, such a formulation is also unsatisfactory in a household detergent composition because of increased costs, supply chain concerns and increased overall formula incompatibility risk when formulating multiple different raw materials.

As such, there remains a need for a cleaning and disinfecting product that provides a log 5 bacterial kill under the EN1276 European Union standard suspension test and maintains a consumer acceptable aesthetics profile while producing an acceptable human and environmentally safe composition.

SUMMARY OF THE INVENTION

The present invention provides improvements in liquid cleaning and disinfecting compositions and in one embodiment liquid antibacterial dishwashing detergent compositions.

In one embodiment, the liquid composition comprises a liquid cleaning and disinfecting hand dishwashing detergent composition comprising at least one surfactant selected from the group consisting of anionic, nonionic, cationic, zwitterionic, amphoteric surfactants, and mixtures thereof, at least one organic solvent and/or at least one hydrotrope, and a single antibacterial active and/or at least one sequestering agent. The cleaning and disinfecting hand dishwashing detergent composition eliminates 99.999% of *Escherichia coli, Pseudomonas aeruginosa, Staphylococcus aureus* and *Enterococcus hirae* in no more than 5 minutes at an 80% product concentration and 20 degrees Celsius according to the EN1276 suspension test.

The present invention further relates to methods of cleaning hard and soft surfaces, such as dishware and dishwashing adjacencies.

DETAILED DESCRIPTION OF THE INVENTION

The cleaning and disinfecting liquid hand dishwashing detergent compositions and methods of the present invention comprise, in one embodiment, at least one surfactant selected from the group consisting of anionic, nonionic, cationic, zwitterionic, amphoteric surfactants, and mixtures thereof, at least one organic solvent and/or at least one hydrotrope, and a single antibacterial active and/or at least one sequestering agent. The cleaning and disinfecting hand dishwashing detergent composition eliminates 99.999% of *Escherichia coli, Pseudomonas aeruginosa, Staphylococcus aureus* and *Enterococcus hirae* in no more than 5 minutes at an 80% product concentration and 20 degrees Celsius according to the EN1276 suspension test.

As used herein a "single antibacterial active" should be read as a "single antibacterial chemistry class", i.e. mixtures of similar actives like derivatives, chain length variations/distributions and substitution level variations exhibiting their chemical bacterial kill action through the same functional group chemistry are considered as a single antibacterial active. As such, formulating a mixture of alkyldimethylbenzylammonium chloride and alkyldimethylethylbenzylammonium chloride, such as in Barquat 4280Z from the Lonza Company, is considered as formulating a single antibacterial active.

As used herein "grease" means materials comprising at least in part (i.e., at least 0.5 wt % by weight of the grease) saturated and unsaturated fats and oils, preferably oils and fats derived from animal sources such as beef and/or chicken.

As used herein "suds profile" means the amount of sudsing (high or low) and the persistence of sudsing (sustained sudsing) throughout the washing process resulting from the use of the liquid detergent composition of the present composition. As used herein "high sudsing" refers to liquid hand dishwashing detergent compositions which are both high sudsing (i.e. a level of sudsing considered acceptable to the consumer) and have sustained sudsing (i.e. a high level of sudsing maintained throughout the dishwashing operation).

This is particularly important with respect to liquid dishwashing detergent compositions as the consumer uses high sudsing as an indicator of the performance of the detergent composition. Moreover, the consumer of a liquid dishwashing detergent composition also uses the sudsing profile as an indicator that the wash solution still contains active detergent ingredients. The consumer usually renews the wash solution when the sudsing subsides. Thus, a low sudsing liquid dishwashing detergent composition formulation will tend to be replaced by the consumer more frequently than is necessary because of the low sudsing level.

As used herein "dishware" means a surface such as dishes, glasses, pots, pans, baking dishes and flatware made from ceramic, china, metal, glass, plastic (polyethylene, polypropylene, polystyrene, etc.) and wood.

As used herein "dishwashing cleaning device or implement" means physical tools to be applied by the consumer during the dishwashing process to get the soil physically removed from the dishware, including but not limited to cloths, sponges and brushes.

As used herein "liquid hand dishwashing detergent composition" refers to those compositions that are employed in manual (i.e. hand) dishwashing. Such compositions are generally high sudsing or foaming in nature.

As used herein "cleaning" means applying to a surface for the purpose of cleaning, and/or disinfecting.

As used herein "low shear viscosity" means a viscosity measured at a shear rate of 0.01/s. "High shear viscosity" means a viscosity measured at a shear rate of 10/s.

As used herein "EN1276" means the EN1276:2009 version put forth by the European committee for standardization.

Rheology Test Method:

To characterize the desired rheology profile, low shear viscosity and high shear viscosity are key parameters to ensure phase stability and phase dissolution. When suspending particles, yield stress is a third rheology parameter to be considered.

High Shear and Low Shear Viscosity:

Viscosity can be determined by conventional methods, e.g. using an AR 550 rheometer from TA instruments using a plate steel spindle at 40 mm diameter and a gap size of 500 μm. The high shear viscosity at 10 s-1 and low shear viscosity at 0.01 s-1 can be obtained from a logarithmic shear rate sweep at 20° C. The procedure consists in 4 steps including a pre-conditioning, a conditioning, a flow ramp up, and a flow ramp down step. The pre-conditioning step consists in a pre-shear at 10 s-1 for 1 min. The conditioning step follows immediately and consists in an oscillation at 0.01 Pa and 1 Hz for 15 min. The flow ramp up follows immediately and consists in shearing the sample at increasing shear rates in steady state flow mode from 0.01 to 100 s-1, for 5 points per decade on a logarithmic scale, allowing measurements to stabilize for a period of from 2 s for up to 20 s with a tolerance of 2 percent. The flow ramp down measurement follows immediately and consists in shearing the sample at decreasing shear rates in steady state flow mode from 100 to 0.001 s-1, for 5 points per decade on a logarithmic scale, allowing measurements to stabilize for a period of from 2 s for up to 20 s with a tolerance of 2 percent. The logarithmic plot of the viscosity vs. shear rate of the flow ramp down experiment is used to determine the low shear viscosity at 0.01 s-1, and the high shear viscosity at 10 s-1.

Yield Stress Tests:

A dynamic yield stress test is conducted. The dynamic yield stress is conducted as follows:

a sample is placed in an AR G2 Stress Controlled Rheometer equipped with double concentric cylinder geometry from TA Instruments ("Rheometer") and subjected to a range of shear from 100 $s^{-1}$ to 0.001 $s^{-1}$. Fifty measurement, spaced apart evenly in a logarithmic scale (as determined by the Rheometer) are performed at varying shear rates within the range stated, and the steady state viscosity and applied stress are measured and recorded for each imposed level of shear rate. The applied stress vs. imposed shear rate data are plotted on a chart and fitted to a modified Hershel-Bulkley model to account for the presence of a constant viscosity at high shear rate provided by the surfactant and adjunct ingredients present in the liquid matrix.

The following equation is used to model the stress of the liquid matrix:

$$\sigma = P1 + P2 * \dot{\gamma}^{P3} + P4 * \dot{\gamma}$$

where: σ: Stress, dependent variable; P1: Yield stress, fit parameter; P2: Viscosity term in Hershel-Bulkley model, fit parameter; $\dot{\gamma}$: Shear rate, independent variable; P3: Exponent in the Hershel-Bulkley model, fit parameter; and P4: Asymptotic viscosity at high shear rate, fit parameter. One of ordinary skill will understand that the fitting procedure due to the Hershel-Bulkley model to the data collected from the sample will output the P1 to P4 parameters, which include the yield stress (P1). The Herschel Bulkley model is described in "Rheometry of Pastes Suspensions and Granular Material" page 163, Philippe Coussot, John Wiley & Sons, Inc., Hoboken, N.J. (2005).

The Liquid Hand Dishwashing Detergent Composition

Meeting the level of antibacterial efficacy as demanded by the EN1276 protocol is very challenging, and successful attempts described to date have only succeeded through formulating high levels of actives with some antibacterial nature and/or mixtures of multiple antibacterial agents. It has been surprisingly found that through a careful selection of ingredients, as described in further detail herein, the EN1276 protocol can be achieved. Without intending to be bound by theory, it is believed that the bacterial kill through the antibacterial agent can be facilitated when attacking bacteria with a range of ingredients such as surfactants, solvents, hydrotropes and sequestering agents that potentiate the antibacterial activity of the antibacterial active and can limit the amount of antibacterial active needed.

The liquid composition of the cleaning and disinfecting liquid household cleaning detergent herein including hand dishwashing, heavy duty laundry and hard surface cleaning liquids, typically contain from 30% to 95%, preferably from 40% to 90%, more preferably from 50% to 85% by weight of a liquid carrier in which the other essential and optional compositions components are dissolved, dispersed or suspended. One preferred component of the liquid carrier is water.

The liquid hand dishwashing compositions herein may have any suitable pH. Preferably the pH of the composition is adjusted to between 3 and 14, more preferably between 4 and 13, more preferably between 6 and 12 most preferably between 8 and 10. The pH of the composition can be adjusted using pH modifying ingredients known in the art.

The cleaning and disinfecting detergent compositions of the present invention can be in the form of liquid, semi-liquid, cream, lotion or gel compositions and, in some embodiments, are intended for use as liquid hand dishwashing detergent compositions for direct or indirect application onto dishware. These compositions include single phase Newtonian or non-Newtonian products with a high shear viscosity of between about 100 cps and 10000 cps at 20° C. and, alternatively, between about 300 cps and about 8000 cps, between about 500 cps and about 5000 cps, between about 700 cps and about 3000 cps, between 900 and 2000 cps, between 1000 and 1500 cps. Alternatively the cleaning and disinfecting product could imply multi-phase products containing at least one visually distinct phase and, alternatively, 2, 3, 4, 5 or more phases, having a high shear viscosity of between about 100 cps and 15,000 cps, between about 500 cps and about 10,000 cps, between about 1,000 cps and about 8,000 cps, between about 2,500 cps and about 5,000 cps and preferably about 4,000 cps, and having a low shear viscosity of between about 10,000 cps and about 500,000 cps, between about 100,000 cps and about 400,000 cps and preferably between about 200,000 cps and about 300,000 cps. Such a preferred rheology may be achieved using internal structurants with detergent ingredients, or by employing an external structurant, or by employing combinations thereof. Multiphase products could be desired when aiming at distributing incompatible or reactive materials amongst the multiple liquid phases, such that the chemical and/or physical stability of the materials is maintained, to prevent problems with physical separation of the materials, or a desired active is generated upon use.

The composition can also have a yield stress value of from about 0.003 Pa to about 5.0 Pa at about 20° C. and, alternatively, from about 0.01 Pa to about 3.0 Pa, from about 0.1 Pa to about 2.0 Pa and from about 0.5 Pa to about 1.0 Pa, as such being enabled to suspend material.

Furthermore, the compositions of the present invention could encompass isotropic or non lamellar phase, lamellar phases or mixtures thereof. It is generally accepted though that lamellar phases poorly solubilizes any appreciable amounts or time compare to other phases and, for this reason, lamelar phases are typically not part of the present invention. However, in some embodiments, lamellar phases may be present.

Surfactants:

The cleaning and disinfecting liquid detergent compositions of the present invention comprise an aqueous cleaning phase that contains a surfactant suitable for application to dishware, skin or fabrics. Suitable surfactants for use herein include any known or otherwise effective cleansing surfactant suitable for application to the skin, and which is otherwise compatible with the other essential ingredients in the aqueous cleansing phase of the compositions. These cleansing surfactants may include anionic, nonionic, cationic, zwitterionic or amphoteric surfactants, or combinations thereof.

Without intending to be bound to theory it is believed that surfactants potentiate the antibacterial activity of the antibacterial active through reducing the surface tension resulting in the dehydration of the nanoscale hydrated hydrophilic portion of the lipid bylayer as well as within the lipopolysacharide coat facilitating access of the active to the bacterial cell membrane.

The aqueous cleansing phase of the liquid detergent compositions comprises surfactant at concentrations ranging from about 1 to about 50%, more preferably from about 5 to about 45%, even more preferably from about 8 to 40%, even more preferably from about 12 to 35% by weight of the liquid detergent composition. In one embodiment of the present invention, the surfactant concentrations ranges from about 1 to about 40%, preferably from about 6 to about 32%, more preferably from about 8 to about 25% weight of the total composition of an anionic surfactant combined with about 0.01 to about 20%, preferably from about 0.2 to about 15%, more preferably from about 0.5 to about 10% by weight of the liquid detergent composition of amphoteric and/or zwitterionic and/or nonionic and/or cationic surfactant, more preferably an amphoteric or zwitterionic and even more preferred an amine oxide surfactant or betaine surfactant, most preferred an amine oxide surfactant. Non-limiting examples of optional surfactants are discussed below.

Anionic Surfactant

In one embodiment of the present invention, the cleaning phase of the present invention will comprise an anionic surfactant typically at a level of 1% to 40%, preferably 6% to 32%, more preferably 8% to 25% weight of the liquid detergent composition. In a preferred embodiment the composition has no more than 15%, preferably no more than 10%, more preferably no more than 5% by weight of the total composition, of a sulfonate surfactant.

Suitable anionic surfactants to be used in the compositions and methods of the present invention are sulfate, sulfonate, sulfosuccinates and/or sulfoacetate; preferably alkyl sulfate and/or alkyl ethoxy sulfates; more preferably a combination of alkyl sulfates and/or alkyl ethoxy sulfates with a combined ethoxylation degree less than 5, preferably less than 3, more preferably less than 2.

Sulphate Surfactants

Suitable sulphate surfactants may include water-soluble salts or acids of $C_{10}$-$C_{14}$ alkyl or hydroxyalkyl, sulphate and/or ether sulfate. Suitable counterions include hydrogen, alkali metal cation or ammonium or substituted ammonium, but preferably sodium.

The hydrocarbyl chain might be linear or branched. Where the hydrocarbyl chain is branched, it preferably comprises $C_{1-4}$ alkyl branching units. Mixtures of anionic surfactants with different branching levels on the hydrocarbyl group might be applied. The average percentage branching of such a mixture of the sulphate surfactants is preferably greater than 20%, more prefereably greater than 30%, more preferably from 35% to 80% and most preferably from 40% to 60% of the total hydrocarbyl chains.

The sulphate surfactants may be selected from $C_8$-$C_{20}$ primary, branched-chain and random alkyl sulphates (AS); $C_{10}$-$C_{18}$ secondary (2,3) alkyl sulphates; $C_{10}$-$C_{18}$ alkyl alkoxy sulphates ($AE_xS$) wherein preferably x is from 1-30; $C_{10}$-$C_{18}$ alkyl alkoxy carboxylates preferably comprising 1-5 ethoxy units; mid-chain branched alkyl sulphates as discussed in U.S. Pat. No. 6,020,303 and U.S. Pat. No. 6,060,443; mid-chain branched alkyl alkoxy sulphates as discussed in U.S. Pat. No. 6,008,181 and U.S. Pat. No. 6,020,303.

Alkyl Sulfosuccinates—Sulfoacetate:

Other suitable anionic surfactants are alkyl, preferably dialkyl, sulfosuccinates and/or sulfoacetate. The dialkyl sulfosuccinates may be a $C_{6-15}$ linear or branched dialkyl sulfosuccinate. The alkyl moieties may be asymmetrical (i.e., different alkyl moiety.es) or preferably symmetrical (i.e., the same alkyl moieties).

Sulphonate Surfactants:

The compositions of the present invention will preferably comprise no more than 15% by weight, preferably no more than 10%, even more preferably no more than 5% by weight of the liquid detergent composition, of a sulphonate surfactant. Those include water-soluble salts or acids of $C_{10}$-$C_{14}$ alkyl or hydroxyalkyl, sulphonates; $C_{11}$-$C_{18}$ alkyl benzene sulphonates (LAS), modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS). Those also include the paraffin sulphonates may be monosulphonates and/or disulphonates, obtained by sulphonating paraffins of 10 to 20 carbon atoms. The sulfonate surfactant also include the alkyl glyceryl sulphonate surfactants. Sulphonated hydrotropes such as cumene sulphonate, toluene sulphonate and xylene sulphonate are not considered as sulphonated surfactants in this application.

Further Surfactants

The compositions can comprise further a surfactant selected from nonionic, cationic, amphoteric, zwitterionic, semi-polar nonionic surfactants, and mixtures thereof. In a further preferred embodiment, the composition of the present invention will further comprise amphoteric and/or zwitterionic surfactant, more preferably an amine oxide or betaine surfactant, most preferably an amine oxide.

The most preferred surfactant system for the compositions of the present invention will therefore comprise: (i) 1% to 40%, preferably 6% to 32%, more preferably 8% to 25% weight of the total composition of an anionic surfactant (2) combined with 0.01% to 20% wt, preferably from 0.2% to 15% wt, more preferably from 0.5% to 10% by weight of the liquid detergent composition of an amphoteric and/or zwitterionic and/or nonionic surfactant, more preferably an amphoteric and even more preferred an amine oxide surfactant. It has been found that such surfactant system will provide the excellent cleaning required from a hand dishwashing liquid composition while being very soft and gentle to the hands. Beyond the amine oxide will also strongly contribute to the antibacterial efficacy of the cleaning and disinfecting product.

The total level of surfactants is usually from about 1 to about 50%, more preferably from about 5 to about 45%, even more preferably from about 8 to 40%, even more preferably from about 12 to 35% by weight of the liquid detergent composition.

Amphoteric and Zwitterionic Surfactants

The amphoteric and zwitterionic surfactant can be comprised at a level of from 0.01% to 20%, preferably from 0.2% to 15%, more preferably 0.5% to 10% by weight of the liquid detergent composition. Suitable amphoteric and zwitterionic surfactants are amine oxides and betaines.

Most preferred are amine oxides, especially alkyl dimethyl amine oxide or alkyl amido propyl dimethyl amine oxide and derivatives thereof. Amine oxide may have a linear or symmetrically or asymmetrically branched alkyl moiety. Typical linear amine oxides include water-soluble amine oxides containing one R1 $C_{8-18}$ alkyl moiety and 2 R2 and R3 moieties selected from the group consisting of $C_{1-3}$ alkyl groups and $C_{1-3}$ hydroxyalkyl groups. Preferably amine oxide is characterized by the formula R1-N(R2)(R3)O wherein $R_1$ is a $C_{8-18}$ alkyl and $R_2$ and $R_3$ are selected from the group consisting of methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides. As used herein "symmetrically-branched" means that the amine oxide has one alkyl moiety having $n_1$ carbon atoms with one alkyl branch on the alkyl moiety having $n_2$ carbon atoms. The alkyl branch is located on the α or β carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably 4, most preferably from 0 to 4 carbon atoms in at least 50 wt %, more preferably at least 75 wt % to 100 wt % of the symmetrically-branched amine oxides for use herein. When $|n_1-n_2|$ is greater than 5 the amine oxide is asymmetrically branched.

The amine oxide further comprises two moieties, independently selected from a $C_{1-3}$ alkyl, a $C_{1-3}$ hydroxyalkyl group, or a polyethylene oxide group containing an average of from about 1 to about 3 ethylene oxide groups. Preferably the two moieties are selected from a $C_{1-3}$ alkyl, more preferably both are selected as a $C_1$ alkyl.

Other suitable surfactants include betaines such alkyl betaines, alkylamidobetaine, amidazoliniumbetaine, sulfobetaine (INCI Sultaines) as well as the Phosphobetaine and preferably meets formula I:

$$R^1—[CO—X(CH_2)_n]_x—N^+(R^2)(R_3)—(CH_2)_m—[CH(OH)—CH_2]_y—Y— \quad \text{(I) wherein}$$

$R^1$ is a saturated or unsaturated C6-22 alkyl residue, preferably C8-18 alkyl residue, in particular a saturated C10-16 alkyl residue, for example a saturated C12-14 alkyl residue;

X is NH, $NR^4$ with C1-4 Alkyl residue $R^4$, O or S, n a number from 1 to 10, preferably 2 to 5, in particular 3, x 0 or 1, preferably 1, $R^2$, $R^3$ are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, $OPO(OR^5)O$ or $P(O)(OR^5)O$, whereby $R^5$ is a hydrogen atom H or a C1-4 alkyl residue.

Preferred betaines are the alkyl betaines of the formula (Ia), the alkyl amido betaine of the formula (Ib), the Sulfo betaines of the formula (Ic) and the Amido sulfobetaine of the formula (Id);

$$R^1—N^+(CH_3)_2—CH_2COO^- \quad \text{(Ia)}$$

$$R^1—CO—NH(CH_2)_3—N^+(CH_3)_2—CH_2COO^- \quad \text{(Ib)}$$

$$R^1—N^+(CH_3)_2—CH_2CH(OH)CH_2SO_3— \quad \text{(Ic)}$$

$R^1—CO—NH—(CH_2)_3—N^+(CH_3)_2—CH_2CH(OH)CH_2SO_3—$ (Id) in which $R^1$1 as the same meaning as in formula I. Particularly preferred betaines are the Carbobetaine [wherein $Y^-$=$COO^-$], in particular the Carbobetaine of the formula (Ia) and (Ib), more preferred are the Alkylamidobetaine of the formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is Cocoamidopropylbetain.

Nonionic Surfactants

Nonionic surfactant, when present, is comprised in a typical amount of from 0.1% to 40%, preferably 0.2% to 20%, most preferably 0.5% to 10% by weight of the liquid detergent composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 of ethylene oxide per mole of alcohol.

Also suitable are alkylpolyglycosides having the formula $R^2O(C_nH_{2n}O)_t(\text{glycosyl})_x$ (formula (III)), wherein $R^2$ of formula (III) is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n of formula (III) is 2 or 3, preferably 2; t of formula (III) is from 0 to 10, preferably 0; and x of formula (III) is from 1.3 to 10, preferably from 1.3 to 3, most preferably from 1.3 to 2.7. The glycosyl is preferably derived from glucose. Also suitable are alkylglycerol ethers and sorbitan esters.

Also suitable are fatty acid amide surfactants having the formula (IV):

$$R^6\overset{\overset{\displaystyle O}{\|}}{C}N(R^7)_2 \qquad \text{(IV)}$$

wherein $R^6$ of formula (IV) is an alkyl group containing from 7 to 21, preferably from 9 to 17, carbon atoms and each $R^7$ of formula (IV) is selected from the group consisting of hydrogen, $C_1$-$C_4$ alkyl, $C_1$-$C_4$ hydroxyalkyl, and $—(C_2H_4O)_xH$ where x of formula (IV) varies from 1 to 3. Preferred amides are $C_8$-$C_{20}$ ammonia amides, monoethanolamides, diethanolamides, and isopropanolamides.

Cationic Surfactants

Cationic surfactants, when present in the composition for enhanced detergency effect, are present in an effective amount, more preferably from 0.25% to 20%, by weight of the liquid detergent composition. Suitable cationic surfactants are quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyethyl or hydroxypropyl groups. Other preferred cationic surfactants include alkyl benzalkonium halides and derivatives thereof. Another preferred cationic surfactant is an $C_6$-$C_{18}$ alkyl or alkenyl ester of a quaternary ammonium alcohol, such as quaternary chlorine esters. More preferably, the cationic surfactants have the formula (V):

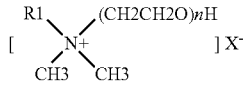

(V)

wherein R1 of formula (V) is $C_8$-$C_{18}$ hydrocarbyl and mixtures thereof, preferably, $C_{8-14}$ alkyl, more preferably, $C_8$, $C_{10}$ or $C_{12}$ alkyl, and X of formula (V) is an anion, preferably, chloride or bromide.

Sequestering Agent:

The cleaning and disinfecting liquid detergent compositions preferably comprise sequestering agents, selected from the group but not limited to carboxylate based builders, chelants, or mixtures thereof. These sequestering agents are known to potentiate the antibacterial activity of an antibacterial active. Without intending to be bound by theory it is believed that chelants in formulated disinfectants affect lipopolysacharide-lipopolysacharide or lipopolysacharide-protein interactions destabilizing the cell wall and resulting in increase cell wall permeability facilitating the active access to the lipid bilayer. The sequestering agent or salt thereof, when present, is preferably present at the level of from 0.01% to 10%, more preferably from 0.1% to 5%, more preferably from 0.15% to 2.5%, more preferably from 0.2% to 1%, and most preferably from 0.25% to 0.5% by weight of the total composition.

Carboxylate Based Builders:

In yet another embodiment of the present invention, the liquid cleaning and disinfecting detergent composition herein may optionally further comprise a linear or cyclic carboxylate, a polycarboxylate, or salt thereof, to potentiate the antibacterial efficacy of the composition. Beyond, the presence of anionic surfactants, especially when present in higher amounts in the region of 15-35% by weight of the total composition, results in the composition imparting a slippery feel to the hands of the user and the dishware. Carboxylates are also known to compensate for this.

Suitable (poly)carboxylates are acyclic, alicyclic, heterocyclic and aromatic carboxylates, in which case they contain at least two carboxylate groups which are in each case separated from one another by, preferably, no more than two carbon atoms. Polycarboxylates which comprise two carboxylate groups include, for example, water-soluble salts of malonic acid, (ethyl enedioxy) diacetic acid, maleic acid, diglycolic acid, tartaric acid, tartronic acid and fumaric acid. Carboxylates useful herein include $C_{1-6}$ linear or at least 3 carbon containing salts of cyclic acids. The linear or cyclic carbon-containing chain of the carboxylate salt thereof may be substituted with a substituent group selected from the group consisting of hydroxyl, ester, ether, aliphatic groups having from 1 to 6, more preferably 1 to 4 carbon atoms, and mixtures thereof.

Preferred carboxylates are those selected from the group consisting of salts of salicylic acid, maleic acid, acetyl salicylic acid, 3 methyl salicylic acid, 4 hydroxy isophthalic acid, dihydroxyfumaric acid, 1,2,4 benzene tricarboxylic acid, pentanoic acid and salts thereof, citric acid, and mixtures thereof. The cation of the salt is preferably selected from alkali metal, alkaline earth metal, monoethanolamine, diethanolamine or triethanolamine and mixtures thereof.

Other carboxylate based builders include homopolymers and copolymers of partially or completely neutralized salts of polycarboxylic acids, monomeric polycarboxylates and hydroxycarboxylic acids. Another suitable polycarboxylate is the homopolymer of neutralized acrylic acid. Preferred salts of the abovementioned compounds are the ammonium and/or alkali metal salts, i.e. the lithium, sodium, and potassium salts, and particularly preferred salts are the sodium salts. Preferred are also the polycarboxylates end capped with sulfonates.

Other carboxylate based chelants of potential interest include water soluble salts of lactic acid, acetic acid, formic acid, succinic acid benzoic acid, salicylic acid and dehydroacetic acid.

The Chelant:

As commonly understood in the detergent field, chelation herein means the binding or complexation of a bi- or multidentate ligand. These ligands, which are often organic compounds, are called chelants, chelators, chelating agents. Chelating agents form multiple bonds with a single metal ion. Chelants, are chemicals that form soluble, complex molecules with certain metal ions, inactivating the ions so that they cannot normally react with other elements or ions. The ligand forms a chelate complex with the substrate. The term is reserved for complexes in which the metal ion is bound to two or more atoms of the chelant. Beyond potentiating of antibacterial efficacy, the chelants might also demonstrate crystal growth inhibition properties, i.e. those that interact with the small calcium and magnesium carbonate particles preventing them from aggregating into hard scale deposit. The particles repel each other and remain suspended in the water or form loose aggregates which may settle. These loose aggregates are easily rinsed away and do not form a deposit.

Suitable chelating agents can be selected from the group consisting of amino carboxylates, amino phosphonates, polyfunctionally-substituted aromatic chelating agents and mixtures thereof.

Preferred chelants for use herein are the amino acids based chelants and preferably glutamic-N,N-diacetic acid (GLDA) or methyl-glycine-diacetic acid (MGDA) and derivatives and/or Phosphonate based chelants and preferably Diethylenetriamine penta methylphosphonic acid (DTPMP) or hydroxyethyldiphosphonic acid (HEDP).

Amino carboxylates include ethylenediaminetetra-acetates, N-hydroxyethylethylenediaminetriacetates, nitrilotriacetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein. As well as MGDA (methyl-glycine-diacetic acid), and salts and derivatives thereof and GLDA (glutamic-N,N-diacetic acid) and salts and derivatives thereof. GLDA (salts and derivatives thereof) is especially preferred according to the invention, with the tetrasodium salt thereof being especially preferred.

Other suitable chelants include amino acid based compound or a succinate based compound. The term "succinate based compound" and "succinic acid based compound" are used interchangeably herein. These include oxodisuccinates, carboxymethyloxysuccinate and mixtures of tartrate monosuccinic and tartrate disuccinic acid such as described in U.S. Pat. No. 4,663,071.

Other suitable chelants are described in U.S. Pat. No. 6,426,229. Particular suitable chelants include; for example, aspartic acid-N-monoacetic acid (ASMA), aspartic acid-N,N-diacetic acid (ASDA), aspartic acid-N-monopropionic acid (ASMP), iminodisuccinic acid (IDS), Imino diacetic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL), N-methyliminodiacetic acid (MIDA), alanine-N,N-diacetic acid (ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts or ammonium salts thereof. Also suitable is ethylenediamine disuccinate ("EDDS"), especially the [S,S] isomer as described in U.S. Pat. No. 4,704,233. Furthermore, Hydroxyethyleneiminodiacetic acid, Hydroxyiminodisuccinic acid, Hydroxyethylene diaminetriacetic acid are also suitable.

Amino phosphonates are also suitable for use as chelating agents and include ethylenediaminetetrakis (methylenephosphonates) as DEQUEST. Preferred, these amino phosphonates that do not contain alkyl or alkenyl groups with more than about 6 carbon atoms.

Polyfunctionally-substituted aromatic chelating agents are also useful in the compositions herein such as described in U.S. Pat. No. 3,812,044. Preferred compounds of this type in acid form are dihydroxydisulfobenzenes such as 1,2-dihydroxy-3,5-disulfobenzene.

Organic Solvents:

The liquid compositions of the present invention may comprise one or more organic solvents as a highly preferred optional ingredient.

Without intending to be bound by theory solvents are believed to evoke bacteriastatic properties at low concentrations by acting as a protein denaturant, inactivating proteins such as enzymes accordingly. Beyond they are believed to also potentiate the antibacterial activity of the antibacterial agent through acting as lipid solvents, thus altering the lipid bilayer within microbial cell membranes accordingly. Some solvents, especially phenolic solvents are believed to also potentiate the antibacterial activity of the antibacterial agent through altering the normal selective permeability of the cytoplasmic membrane.

Suitable solvents are selected from the group consisting of C4-14 preferably C6-C12 even more preferably C8-C10 ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, alkanolamines, terpenes and mixtures thereof.

Suitable glycols to be used herein are according to the formula HO—CR1R2-OH wherein R1 and R2 are independently H or a C2-C10 saturated or unsaturated aliphatic hydrocarbon chain and/or cyclic. Suitable glycols to be used herein are dodecaneglycol and/or propanediol, and derivatives thereof such as bronopol (2-bromo-2-nitropropane-1,3-diol).

Suitable alkoxylated glycols to be used herein are according to the formula R-(A)n-R1-OH wherein R is H, OH, a linear or branched, saturated or unsaturated alkyl of from 1 to 20 carbon atoms, preferably from 2 to 15 and more preferably from 2 to 10, wherein R1 is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols to be used herein are according to the formula R-(A)n-OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable alkoxylated aliphatic alcohols to be used herein are according to the formula R-(A)n-OH wherein R is a linear or branched, saturated or unsaturated alkyl group of from 1 to 20 carbon atoms, preferably from 2 to 15 and more preferably from 3 to 12, wherein A is an alkoxy group preferably butoxy, propoxy and/or ethoxy, and n is an integer of from 1 to 5, preferably 1 to 2. Suitable alkoxylated aliphatic linear or branched alcohols are butoxy propoxy propanol (n-BPP), butoxyethanol, butoxypropanol (n-BP), ethoxyethanol, 1-methylpropoxyethanol, 2-methylbutoxyethanol, Hexyl glycol ether and Hexyl diglycolether or mixtures thereof.

Suitable aliphatic alcohols to be used herein are according to the formula R—OH wherein R is a linear or branched, saturated or unsaturated alkyl group of from 1 to 20 carbon atoms, preferably from 2 to 15 and more preferably from 5 to 12. With the proviso that said aliphatic branched alcohols is not a 2-alkyl alkanol as described herein above. Suitable aliphatic alcohols are methanol, ethanol, propanol, isopropanol or mixtures thereof.

Suitable alkanolamines to be used herein include but are not limited to monoethanolamine, diethanolamine and triethanolamine.

Suitable terpenes to be used herein monocyclic terpenes, dicyclic terpenes and/or acyclic terpenes. Suitable terpenes are: D-limonene; pinene; terpinene; terpene derivatives as menthol, terpineol, geraniol, and the citronella or citronellol types of ingredients.

Other suitable solvents include butyl diglycol ether (BDGE), hexandiols, butyltriglycol ether, teramilic alcohol and the like. BDGE is commercially available from from BASF under the trade name Butyl CARBITOL®. Alternatively also diamines can be used. Specific examples of diamines are described further in the document in the other optional ingredients section.

Preferably said solvent is selected from the group consisting of butoxy propoxy propanol, butyl diglycol ether, benzyl alcohol, butoxypropanol, ethanol, methanol, isopropanol, hexandiols and mixtures thereof. More preferably said solvent is selected from the group consisting of butoxy propoxy propanol, benzyl alcohol, butoxypropanol, ethanol, methanol, isopropanol and mixtures thereof. Even more preferably said solvent is selected from the group consisting of benzyl alcohol, ethanol and mixtures thereof.

When present, the liquid detergent composition will contain from about 0.01% to about 20%, alternatively from about 0.5% to about 18%, alternatively from about 1% to about 15%, alternatively from 2% to 10%, alternatively 3 to 6% by weight of the liquid detergent composition of said organic solvent. These organic solvents may be used in conjunction with water, or they may be used without water.

Alternatively hydrotropes might also be applied alone or in combination with any of the organic solvents mentioned above, to exhibit their solvent action, in an effective amount, i.e. from about 0.01% to about 25%, alternatively from about 0.5% to about 20%, alternatively from about 1% to about 15%, alternatively from 2% to 10%, alternatively 3 to 6% by weight of the liquid detergent composition. Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, as disclosed in U.S. Pat. No. 3,915,903.

Antibacterial Actives:

In another embodiment of this present invention the cleaning and disinfecting liquid detergent composition can also comprise an antibacterial active. When present, the liquid detergent composition will contain from about 0.001% to about 2%, alternatively from about 0.005% to about 1.5%, alternatively from about 0.01% to about 1%, alternatively from 0.05% to 0.1%, by weight of the liquid detergent composition of said antibacterial active.

An antibacterial active is a registered chemical substance used in formulations primarily for the intended purpose for killing microorganisms. The choice of antibacterial active to be used depends on the particular situation. Some antibacterial actives have a broad spectrum (kill many different types of microorganisms), while others kill a limited spectrum of organisms but are preferred for other properties (they may be stable within the formula matrix, non-corrosive, non-toxic, etc.). Within Western Europe, the antibacterial actives that can be used in detergent applications are classified within the "Biocidal Products Directive 98/8/EC (BPD"), more particularly within "MAIN GROUP 1: Disinfectants and general biocidal products—Product-type 2: Private area and public health area disinfectants and other biocidal products and Product-type 4: Food and feed area disinfectants" and under the Biocidal Products Regulation, more particularly within "MAIN GROUP 1: Disinfectants—Product-type 2: Disinfectants and algaecides not intended for direct application to humans or animals, and Product-type 4: Food and feed area disinfectants". Within North America, antibacterial products and actives that can be used are regulated by the FDA and EPA. Potentially the antibacterial actives can be combined with technologies potentiating the antibacterial activity of the antibacterial active such as chelants, solvents and surfactants, or can be combined with an antibacterial active carrying agent to improve deposition efficacy, especially metal ions preferably $Zn^{2+}$-ion, or could be bound to a deposition technology like a surface substantive deposition polymer to deliver a long lasting disinfection efficacy.

Typical chemistry classes with illustrating examples being used demonstrating intrinsic antibacterial activity include but are not limited to aldehydes (formaldehyde, glutaraldehyde, ortho-phtalaldehyde), sulphur dioxide, sulphites, bisulphites, vanillic acid esters), chlorine and oxygen based oxidizing agents (sodium and calcium hypochlorite or hypobromite, chloramine and chloramine-T, chlorine dioxide, hydrogen peroxide, iodine, ozone, peracetic acid, performic acid, potassium permanganate, potassium peroxymonosulfate), phenolics (phenol, o-phenylphenol, chloroxylenol, hexachlorophene, amylmetacresol, 2,4-dichlorobenzyl alcohol, policresylen, fentichlor, 4-allylcatechol, p-hydroxybenzoic acid esters including benzylparaben, butylparaben, ethylparaben, methtlparaben and propylparaben, butylated hydroxyanisole, butylated hydroxytoluene, capaicin, carvacrol, creosol, eugenol, guaiacol), halogenated (hydroxy)diphenylethers (diclosan, triclosan, hexachlorophene and bromochlorophene, 4-hexylresorcinol, 8-hydroxyquinoline and salts thereof), quaternary ammonium compounds (benzalkonium chloride derivatives, benzethonium chloride derivatives, cetrimonium chloride/bromide, cetylpyridinium, cetrimide, benzoxonium chloride, didecyldimethyl ammonium chloride), acridine derivatives (ethacridine lactate, 9-aminoacridine, euflavine), biguanides including polymeric biguanides, and amidines (polyaminopropyl biguanide, dibrompropamidine, chlorhexidine, alexidine, propamidine, hexamidine, polihexanide), nitrofuran derivatives (nitrofurazone), quinoline derivatives (dequalinium, chlorquinaldol, oxyquinoline, clioquinol), iodine products, essential oils (bay, cinnamon, clove, thyme, eucalyptus, peppermint, lemon, magnolia extract, menthol, geraniol), cations-, Anilides (saclicylanilide, Diphenylureas), salicylic acid esters including menthyl salicylate, methyl salicylate and phenyl salicylate, pyrocatechol, phtalic acid and salts thereof, hexetidine, octenidine, sanguinarine, domiphen bromide, alkylpyridinium chlorides such as cetylpyridinium chloride, tetradecylpyridinium chloride and N-tetradecyl-4-ethylpyridinium chloride, iodine, sulfonamides, piperidino derivatives such as delmopinol and octapinol, and mixtures thereof, miscellaneous preservatives (derivatives of 1,3-dioxane, derivatives of imidazole, Isothizolones, derivatives of hexamine, triazines, oxazolo-oxazoles, sodium hydroxymethylglycinate, methylene bisthiocyanate, captan).

Preferred antibacterial systems are halogenated benzyl alcohol derivatives such as chloroxylenol (PCMX), halogenated hydroxydiphenylethers preferably dicosan, quaternary ammonium salts preferably alkylbenzalkonium and alkylbenzethonium chloride and derivatives thereof, and mixtures thereof. Most preferred antibacterial system is diclosan.

The efficacy of these preferred antibacterial active systems can be further facilitated behind potentiating agents such as co-formulation with a sequesterant especially citrate and chelants, a solvent and/or a surfactant, or alternatively through combining them with antibacterial active deposition aids.

Bleach Actives:

The cleaning and disinfecting detergent composition may also contain a bleach or bleach system, preferably a peroxide bleach, possibly in combinations with chelant, radical scavenger and specific surfactant system such as dodecyl dimethylamine oxide and derivatives to enable higher finished product pH, typically up to pH 9. More details are described in EPO application serial number 10177812.4. The peroxygen bleach component in the composition can also be formulated with an activator (peracid precursor). Possible activators include but are not limited to tetraacetyl ethylene diamine (TAED), benzoylcaprolactam and valerolactam derivatives, alkanoyloxybenzenesulphonate such as nonanoyloxybenzenesulphonate (NOBS), perhydrolyzable esters, and mixtures thereof. Further non-limiting list of examples, including quaternary substituted bleach activators, are described in U.S. Pat. No. 6,855,680. Alternatively organic peroxides such as diacylperoxides such as dibenzoyl peroxide can also be considered. Alternatively the composition might also comprise a bleach catalyst such as Metal-containing Bleach Catalysts preferably manganese and cobalt containing bleach catalysts, Transition Metal Complexes of Macropolycyclic Rigid Ligands, or Other Bleach Catalysts such as organic bleach catalysts such as zwitterionic bleach catalysts including aryliminium zwitterions, and cationic bleach catalysts. Alternatively the composition may also comprise a preformed peracid such as phtalimidio peroxycaproic acid (PAP) or percarboxylic or percarbonic or perimidic or peroxymonosulfuric acid, or a bleaching enzyme.

A more detailed bleach description is given in U.S. Patent Application No. 61/512,150.

Other Components:

The cleaning and disinfecting liquid detergent compositions herein can further comprise a number of other components suitable for use in liquid detergent compositions such as but not limited to internal or external structuring systems, skin care actives including cationic conditioning polymers, humectants, emollients, enzymes and skin rejuvenation actives, polymers including cleaning or soil anti-redeposition polymers, surface modifying polymers and soil flocculating polymers, suspended particles including beads, cleaning and/or exfoliating particles, air bubbles, perfume microcapsules and pearlescent agents, perfume and malodor control compounds, colorants, organic and inorganic opacifiers, organic and inorganic cations such as alkaline earth metals such as Ca/Mg-ions and diamines, suds stabilizers/boosters, anticaking agents, viscosity trimming agents (e.g. salt such as NaCl and other mono-, di- and trivalent salts), preservatives and pH trimming and/or buffering means (e.g. carboxylic acids such as citric acid, HCl, NaOH, KOH, amines and alkanolamines, phosphoric and sulfonic acids, carbonates such as sodium carbonates, bicarbonates, sesquicarbonates, borates, silicates, phosphates, imidazole and alike).

A more detailed description of these optional ingredients is given in in U.S. Patent Application No. 61/512,150.

Packaging:

The liquid detergent compositions of the present invention may be packed in any suitable packaging for delivering the liquid detergent composition for use. Preferably, the package is a transparent or translucent package made of glass or plastic so that consumers can see the product throughout the packaging.

The Process of Cleaning/Treating a Hard Surface

Another embodiment of the present invention is directed to a process of cleaning a hard surface, such as dishware, with a composition of the present invention. Said processes comprises the step of applying the composition onto the hard surface, such as dishware, typically in diluted or neat form and rinsing or leaving the composition to dry on the surface without rinsing the surface.

By "in its neat form", it is meant herein that said liquid composition is applied directly onto the surface to be treated and/or onto a cleaning device or implement such as a dish cloth, a sponge or a dish brush without undergoing any dilution at 0 gpg water hardness by the user (immediately) prior to the application. By "diluted form", it is meant herein that said liquid composition is diluted by the user with an appropriate solvent, typically water. By "rinsing", it is meant herein contacting the dishware cleaned with the process according to the present invention with substantial quantities of appropriate solvent, typically water, after the step of applying the liquid composition herein onto said dishware. By "substantial quantities", it is meant usually about 5 to about 20 liters.

In one embodiment of the present invention, the composition herein can be applied in its diluted form. Soiled dishes are contacted with an effective amount, typically from about 0.5 ml to about 20 ml (per about 25 dishes being treated), preferably from about 3 ml to about 10 ml, of the liquid detergent composition of the present invention diluted in water. The actual amount of liquid detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. Generally, from about 0.01 ml to about 150 ml, preferably from about 3 ml to about 40 ml of a liquid detergent composition of the invention is combined with from about 2000 ml to about 20000 ml, more typically from about 5000 ml to about 15000 ml of water in a sink having a volumetric capacity in the range of from about 1000 ml to about 20000 ml, more typically from about 5000 ml to about 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from about 1 to about 10 seconds, although the actual time will vary with each application and user. The contacting of cloth, sponge, or similar article to the dish surface is preferably accompanied by a concurrent scrubbing of the dish surface.

Another method of the present invention will comprise immersing the soiled dishes into a water bath or held under running water without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

Alternatively, the device may be immersed in a mixture of the hand dishwashing composition and water prior to being contacted with the dish surface, the concentrated solution is made by diluting the hand dishwashing composition with water in a small container that can accommodate the cleaning device at weight ratios ranging from about 95:5 to about 5:95, preferably about 80:20 to about 20:80 and more preferably about 70:30 to about 30:70, respectively, of hand dishwashing liquid:water respectively depending upon the user habits and the cleaning task.

Dependent on the geography of use of the composition, the water used in the method of the present invention can have a hardness level of about 0-30 gpg ("gpg" is a measure of water hardness that is well known to those skilled in the art, and it stands for "grains per gallon").

The Process of Treating a Cleaning Device or Implement

In one embodiment we also aim to disinfect cleaning devices or implements. More particularly the cleaning and disinfecting liquid is applied "in its neat form", directly onto a humid or dry cleaning device or implement such as a dish cloth, a sponge or a dish brush, and left without undergoing any substantial dilution (ie. more than the humidity already present in the cleaning device or implement prior to applying the cleaning and disinfecting liquid) for about 30 seconds, preferably about 5 minutes up to about 24 hours, i.e. till the next dishwashing process is initiated.

The Process of Treating Skin or Hard Surfaces

In yet another embodiment, the liquid cleaning composition can applied to a user's skin or to hard surfaces, such as dishware, cutting boards and kitchen surfaces. More particularly the liquid cleaning composition is applied "in its neat or in its diluted form", directly or through an implement onto a humid or dry skin or a hard surface, such as a dishware or kitchen surfaces, left to act for about 30 seconds, preferably about 5 minutes up to about 24 hours, optionally followed by a rinsing step.

EXAMPLES

Table 1 describes a traditional Hand Dishwashing liquid formulation, not meeting the requirements of the EN1276 protocol.

TABLE 1

| (Reference A formula): | |
|---|---|
| Ingredient | Active level (as 100% active) |
| Surfactant (C11-13E0.6S/Alkyldimethyl-amineoxide—4.4/1-ratio) | 28.6% |
| Ethanol | 3.3% |
| Sodium cumene sulphonate (SCS) | 3% |
| Na-citrate | 2% |
| NaCl | 1.3% |
| NaOH | Trimming agent till pH 9 (10% solution) |
| Aesthetics—preservative-water | Till 100% |
| EN1276 performance | Log kill (success criteria = >5 on all 4 bacteria) |
| *E. Coli* | <5 |
| *S. aureus* | <5 |
| *Ps. aeruginosa* | <5 |
| *E. Hirae* | >5 |

Table 2 gives a representative selection of a broad set of typical antibacterial (AB) technology classes single variable added on top of the starting formulation at typical levels recommended for antibacterial efficacy, however not sufficiently boosting the antibacterial activity, illustrating the challenge of passing against this EN1276 protocol with typical antibacterial technologies. A careful selection of surfactant, solvent and optionally chelant beyond the antibacterial active is required to potentiate the antibacterial activity of the antibacterial agent and as such facilitate bacterial kill by the antibacterial active to pass against this EN1276 norm (see table 3). Indeed, when not sufficiently potentiating the antibacterial activity of the antibacterial agent through weakening one of the different mechanisms (surfactant, solvent or chelant reduction) the overall success criteria is not met anymore and higher levels of antibacterial active would be required (see table 4).

TABLE 2

| Ref A + AB active | *E. Coli* | *S. aureus* | *P. aeruginosa* | *E. Hirae* | PASS/FAIL |
|---|---|---|---|---|---|
| +0.3% Geraniol | <5 | >5 | <5 | >5 | FAIL |
| +0.06 phenylphenol | <5 | <5 | <5 | >5 | FAIL |
| +0.3% benzalkoniumchloride | <5 | <5 | <5 | >5 | FAIL |
| +3% Lonzabac | <5 | <5 | <5 | >5 | FAIL |
| +1% Hydroxypyridine | <5 | <5 | <5 | >5 | FAIL |
| +1% Glydant 2000 | <5 | <5 | <5 | >5 | FAIL |
| +3% 2-bromo-2-nitropropane | <5 | <5 | <5 | >5 | FAIL |

TABLE 3

| | solvent | hydrotrope | chelant | AB active | *E. Coli* | *S. aureus* | *PS. aerruginosa* | *E. Hirae* | PASS/FAIL |
|---|---|---|---|---|---|---|---|---|---|
| Formulas B and C = Ref A with add on tabulated solvent/hydrotrope/chelant/AB ingredients. | | | | | | | | | |
| | | Ref A ex Table 1 | | | <5 | <5 | <5 | >5 | FAIL |
| B | +0.8% Benzyl Alcohol (BA) + 0.46% EtOH | +0.5% SCS | +1% Citrate | — | >5 | >5 | >5 | >5 | PASS (optimum solvent - surfactant - chelant balance) |
| C | Ref A +0.5% BA + 0.46% EtOH | +0.5% SCS | +1% Citrate | +0.05% Diclosan | >5 | >5 | >5 | >5 | PASS (optimum solvent surfactant - AB active - chelant balance) |

Passing the EN1276 success criteria can also be met through significantly increasing the solvent/hydrotrope (f.e. +2% propanediol, +2% SCS) and surfactant levels (+10%) inside of the reference formulation, hence potentiating the antibacterial activity of the antibacterial agent to the extreme such that bacteria would not survive anymore even in absence of antibacterial agent, however this would lead to an unacceptable viscosity profile (too high solvent level leading into too low high shear viscosity profile, i.e. over 300 cps viscosity drop) or an unaffordable formula proposition (increased surfactant). These formula approaches are not preferred as such. Therefore a careful balancing of surfactant, solvent and optionally chelant to potentiate the antibacterial activity of the antibacterial active, and antibacterial active to induce bacterial kill, as in table 3 examples is required to balance AB performance versus other product characteristics.

TABLE 4

| | solvent | hydrotrope | chelant | AB active | *E. Coli* | *S. aureus* | *PS. aerruginosa* | *E. Hirae* | PASS/ FAIL |
|---|---|---|---|---|---|---|---|---|---|
| Formulas = Ref A with add on tabulated solvent/hydrotrope/chelant/AB ingredients. | | | | | | | | | |
| Single variable AB active reduction: | | | | | | | | | |
| C | +0.5% BA + 0.46% EtOH | +0.5% SCS | +1% Citrate | +0.05% Diclosan | >5 | >5 | >5 | >5 | PASS (optimum solvent surfactant - AB active - chelant balance) |
| D | +0.5% BA + 0.46% EtOH | +0.5% SCS | +1% Citrate | — | <5 | >5 | >5 | >5 | FAIL (no AB active in D vs C) |
| Single variable solvent reduction: | | | | | | | | | |
| B | +0.8% Benzyl Alcohol (BA) + 0.46% EtOH | +0.5% SCS | +1% Citrate | — | >5 | >5 | >5 | >5 | PASS (optimum solvent - surfactant - chelant balance) |
| D | +0.5% BA + 0.46% EtOH | +0.5% SCS | +1% Citrate | — | <5 | >5 | >5 | >5 | FAIL (less solvent vs B) |
| C | Ref A +0.5% BA + 0.46% EtOH | +0.5% SCS | +1% Citrate | +0.05% Diclosan | >5 | >5 | >5 | >5 | PASS (optimum solvent surfactant - AB active - chelant balance) |
| E | +0.46% EtOH | +0.5% SCS | +1% Citrate | +0.1% diclosan | <5 | >5 | >5 | >5 | FAIL (less solvent, i.e. benzyl alcohol vs C) |

TABLE 4-continued

Formulas = Ref A with add on tabulated solvent/hydrotrope/chelant/AB ingredients.

| | solvent | hydrotrope | chelant | AB active | *E. Coli* | *S. aureus* | *PS. aerruginosa* | *E. Hirae* | PASS/ FAIL |
|---|---|---|---|---|---|---|---|---|---|
| F | +0.5% BA | +0.5% SCS | +1% Citrate | +0.05% diclosan | <5 | >5 | >5 | >5 | FAIL (less solvent, i.e. ethanol vs C)* |

*Ethanol level decrease effect will also be achieved through reducing surfactant and/or chelant active level, as ethanol level will have to decrease accordingly to still meet target finished product viscosity profile, balancing the drop in viscosity arising from the surfactant and/or chelant reduction accordingly.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid cleaning and disinfecting hand dishwashing detergent composition comprising:

a) at least one surfactant comprising an alkyl ethoxy sulfate;

b) from about 0.1% to about 0.9%, by weight of the total composition, of benzyl alcohol;

c) from about 3% to about 6%, by weight of the total composition, of ethanol;

d) a single antibacterial active present from about 0.001% to about 2% by weight of the total composition and is selected from the group consisting of halogenated benzyl alcohol derivatives, halogenated hydroxydiphenylethers, quaternary ammonium salts, a peroxide bleach system;

e) at least one hydrotope selected from the group consisting of organic salts of cumene sulphonate, xylene sulphonate and toluene sulphonate, inorganic salts of cumene sulphonate, xylene sulphonate and toluene sulphonate, and mixtures thereof; and f) about 0.1% to about 5%, by weight of said composition, of a chelant;

wherein the cleaning and disinfecting hand dishwashing detergent composition eliminates 99.999% of *Escherichia coli, Pseudomonas aeruginosa, Staphylococcus aureus* and *Enterococcus hirae* in no more than 5 minutes at an 80% product concentration and 20 degrees Celsius according to the EN1276 suspension test.

2. A liquid cleaning and disinfecting composition according to claim 1 comprising from about 4% to about 40% by weight of the total composition of an anionic surfactant.

3. A liquid cleaning and disinfecting composition according to claim 1 further comprising a nonionic surfactant selected from the group consisting of C8-C22 aliphatic alcohols with 1 to 25 moles of ethylene oxide, alkylpolyglycosides, fatty acid amide surfactants, and mixtures thereof.

4. A liquid cleaning and disinfecting composition according to claim 1 further comprising an organic or an inorganic divalent metal salt.

5. A liquid cleaning and disinfecting composition according to claim 1, comprising from about 0.01% to about 25% by weight of the total composition of said hydrotrope.

6. A liquid cleaning and disinfecting composition according to claim 1, wherein the antibacterial active is co-formulated with a carrying agent or is bound to a deposition polymer.

7. A liquid cleaning and disinfecting composition according to claim 1, comprising from about 0.01% to about 10% by weight of the total composition of a said dhelant agent selected from the group consisting of carboxylic acid based builders, amino carboxylate chelants, amino phosphonate chelants, polyfunctionally-substituted aromatic chelating agents and mixtures thereof.

8. A liquid cleaning and disinfecting composition according to claim 1, wherein the composition has a high shear viscosity profile of between about 100 cps and about 10000 cps at 20° C.

9. A method of cleaning and disinfecting dishware and/or dishwashing implements and/or skin with a liquid cleaning and disinfecting composition according to claim 1, the method comprising the steps of applying the composition onto the dishware and/or dishwashing implement and/or skin.

10. A liquid cleaning and disinfecting hand dishwashing detergent composition comprising:

a) at least one surfactant selected from the group consisting of anionic, nonionic, cationic, zwitterionic, amphoteric surfactants, and mixtures thereof;

b) about 0.8% to about 0.9%, by weight of the total composition, of benzyl alcohol and from about 3% to about 6%, by weight of the total composition, of ethanol;

c) at least one hydrotrope comprising from about 0.01% to about 25%, by weight of the total composition, of sodium cumene sulphonate;

d) at least one sequestering agent comprising from about 0.5% to about 2%, by weight of the total composition, of citrate; and wherein the cleaning and disinfecting hand dishwashing detergent composition eliminates 99.999% of *Escherichia coli, Pseudomonas aeruginosa, Staphylococcus aureus* and

*Enterococcus hirae* in no more than 5 minutes at an 80% product concentration and 20 degrees Celsius according to the EN1276 suspension test.

11. The liquid cleaning and disinfecting hand dishwashing detergent composition according to claim 10, wherein said at least one hydrotrope comprises from about 3% to about 6%, by weight of the total composition, of sodium cumene sulphonate.

12. The liquid cleaning and disinfecting hand dishwashing detergent composition according to claim 10 further comprising a single antibacterial active present from about 0.001% to about 2% by weight of the total composition and is selected from the group consisting of halogenated benzyl alcohol derivatives, halogenated hydroxydiphenylethers, quaternary ammonium salts, a peroxide bleach system.

13. The liquid cleaning and disinfecting composition according to claim 10 comprising from about 4% to about 40% by weight of the total composition of an anionic surfactant.

14. A liquid cleaning and disinfecting composition according to claim 13, wherein the anionic surfactant is selected from the group consisting of alkyl sulfate, alkyl ethoxy sulfates and mixtures thereof.

15. A liquid cleaning and disinfecting composition according to claim 10 comprising a nonionic surfactant selected from the group consisting of C8-C22 aliphatic alcohols with 1 to 25 moles of ethylene oxide, alkylpolyglycosides, fatty acid amide surfactants, and mixtures thereof.

* * * * *

UNITED STATES PATENT AND TRADEMARK OFFICE

CERTIFICATE OF CORRECTION

PATENT NO. : 8,993,500 B2
APPLICATION NO. : 14/331253
DATED : March 31, 2015
INVENTOR(S) : Jamila Tajmamet et al.

It is certified that error appears in the above-identified patent and that said Letters Patent is hereby corrected as shown below:

In the Claims,

Column 22, in claim 7, line 3, delete “dhelant” and insert -- chelant --.

Signed and Sealed this
Fourteenth Day of July, 2015

Michelle K. Lee

Michelle K. Lee
*Director of the United States Patent and Trademark Office*